US006325671B1

(12) United States Patent
Radliff

(10) Patent No.: US 6,325,671 B1
(45) Date of Patent: Dec. 4, 2001

(54) ENCLOSURE FOR SPLICED CABLE HAVING STRAIN RELIEF FERRULE

(75) Inventor: David Ray Radliff, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 09/629,928

(22) Filed: Aug. 1, 2000

(51) Int. Cl.[7] ..... H01R 09/03
(52) U.S. Cl. ..... 439/610
(58) Field of Search ..... 439/601, 402, 439/865, 907, 417, 398, 397, 99

(56) References Cited

U.S. PATENT DOCUMENTS

| | | | | |
|---|---|---|---|---|
| 3,458,649 | | 7/1969 | Channell | 174/93 |
| 4,744,769 | | 5/1988 | Grabbe et al. | 439/284 |
| 5,606,150 | | 2/1997 | Radliff et al. | 174/92 |
| 5,722,841 | | 3/1998 | Wright | 439/98 |
| 5,746,610 | * | 5/1998 | Shiu | 439/98 |
| 5,831,815 | | 11/1998 | Miller et al. | 361/679 |
| 6,087,584 | * | 7/2000 | Daoud | 174/50.59 |
| 6,111,201 | * | 8/2000 | Drane et al. | 174/92 |

* cited by examiner

*Primary Examiner*—Gary Paumen
*Assistant Examiner*—Phuongchi Nguyen

(57) ABSTRACT

A splicing enclosure is comprised of a base portion and a lid portion, with a grounding contact positioned in both halves. The grounding contacts include a plurality of grounding contact portions to receive shielded cable in a transverse relation thereto. The enclosure is provided with a removable ferrule, which can be slidably received between the shielding and inner sheath of a shielded cable to enhance the strain relief on the cable between the cable and the grounding contact. The grounding contact is designed so as to accommodate a plurality of shielded cable configurations. The enclosure is also provided with a progressive latch, which cooperates upon rotation of the lid relative to its base portion to take off the load from the integrated hinge to prevent breakage of the hinge.

20 Claims, 10 Drawing Sheets

ENCLOSURE FOR SPLICED CABLE HAVING STRAIN RELIEF FERRULE

FIELD OF THE INVENTION

The present invention relates to the field of electrical connections and more particularly to enclosures for spliced cable connections such as telephone wires.

BACKGROUND OF THE INVENTION

It is common in the telephone industry, where cable splices need to be made along the path of distribution, that splices be made which will include some type of an electrical connection to splice the individual wires of the cable and environmentally seal them in a connection enclosure to prevent degradation to the connection. This type of splice could be either a so-called drop wire splice or could be a buried splice in the case of underground cable. It is also common to have both six and twelve pairs of twisted wire, which comprise the telephone cable.

As in almost any electrical connection device, where a cable is involved, and where an individual wire or a plurality of wires are interconnected to terminals or like wires, a so-called strain relief mechanism is desirable, such that tension or force outwardly on the cable is not transmitted to the electrical connection of the wires, but rather the force as transmitted to a housing into which the cable is being terminated. Various strain relief mechanisms exist in the marketplace and in the prior art for transferring the forces to the connector housings.

One such device is shown in the Tyco Electronics (AMP Division) commercial product known as the CERTI-SEAL wire splice enclosure (for 2- to 6-pair buried drop wire splice) where the housing is formed as a shell of two similar halves, where one of the halves includes grounding contact. The cables to be spliced are brought in from opposite ends and the cables are stripped to expose the individual wires to be spliced, and a section of the shielding. The two wires are positioned in the grounding contact to common or ground the two shields. Splice connection blocks known as TEL-SPLICE (also a commercial of Tyco Electronics) then interconnect the individual wires to one another for making the individual wire splices.

While the above-mentioned connection assembly is adequate for its intended use, it would be, however, advantageous to provide such a splice enclosure, which can accommodate more than one cable size, in order that the enclosure can accommodate at least 6-pair and 12-pair cable. it would also be advantageous if the enclosure could accept three cables, such that the enclosure could terminate combinations of cable, for example, two 6-pair; two 12-pair; or a 12-pair to two 6-pair.

SUMMARY OF THE INVENTION

The objects of the invention have been accomplished by providing an electrical splicing enclosure for splicing a plurality of shielded cables, which comprises an insulating housing having a first housing member and a second housing member, where the first housing member is hinged to the second housing member so that the first housing member and second housing member are movable from an open position to a closed position. The first housing member and the second housing member overlie each other, with the first housing member and the second housing member each having a base wall, and a peripheral wall, the peripheral walls conforming to provide an enclosure when in the closed position. At least two cable receiving openings are provided through the housing for the cables to be spliced. Grounding contacts, carried by the first and second housing members, comprise cable receiving slots having gripping edges to grip shielding of the shielded cables to be spliced, and the grounding contacts being profiled for overlapping contact with the cables, so as to trap the cable there between, and to provide strain relief thereto.

Preferably, the grounding contacts are comprised of a unitary member having multiple cable receiving slots. The grounding contacts are comprised of a base contact portion having upstanding wall sections extending from marginal edges thereof, with the cable receiving slots are formed in the upstanding wall sections. The cable receiving slots are comprised of upwardly facing openings in opposing walls of the upstanding wall sections, such that the cables are terminated transversely of the upstanding wall sections. The grounding contacts have at least one central cable-receiving slot and an end cable-receiving slot on opposite sides of the central cable-receiving slot. The end cable-receiving slots are profiled to accept a plurality of wire sizes. The base contact portions of the grounding contacts are deformable through a line parallel with the slots.

Also preferably, a ferrule is insertable under the shielding of the cables to be spliced, to enhance the strain relief effect on the cable.

In another embodiment of the invention, an electrical splicing enclosure for splicing a plurality of shielded cables comprises an insulating housing for enclosing cables to be spliced having at least two cable receiving openings provided therethrough for the cables to be spliced. The enclosure has at least one grounding contact carried by one of the housing members, the grounding contact comprising cable receiving slots having gripping edges to grip shielding of the shielded cable to be spliced. A ferrule is included which is profiled to be receivable beneath the shielding of cables to be spliced to rigidify the connection and strain relief of the cable with the grounding contact.

Preferably, the housing comprises a first housing member and a second housing member, the first housing member being hinged to the second housing member so that the first housing member and second housing member are movable from an open position to a closed position where the first housing member and the second housing member overlie each other. The first housing member and the second housing member each having a base wall, and a peripheral wall, the peripheral walls conforming to provide an enclosure when in the closed position. The two grounding contacts are carried by the first and second housing members, the grounding contacts comprising cable receiving slots having gripping edges to grip shielding of the shielded cables to be spliced, and the grounding contacts are profiled for overlapping contact with the cables, so as to trap the cable there between, and to provide strain relief thereto. The grounding contacts are comprised of a unitary member having multiple cable receiving slots. The grounding contacts are comprised of a base contact portion having upstanding wall sections extending from marginal edges thereof, and the cable receiving slots are formed in the upstanding wall sections. The cable receiving slots are comprised of upwardly facing openings in opposing walls of the upstanding wall sections, such that the cables are terminated transversely of the upstanding wall sections. The grounding contacts have at least one central cable receiving slot and an end cable-receiving slot on opposite sides of the central cable-receiving slot. The end cable-receiving slots are profiled to accept a plurality of wire sizes. The base contact portions of the grounding contacts are deformable through a line parallel with the slots.

DETAILED DESCRIPTION OF THE PREFERRED EMBODIMENT

Figure 1:
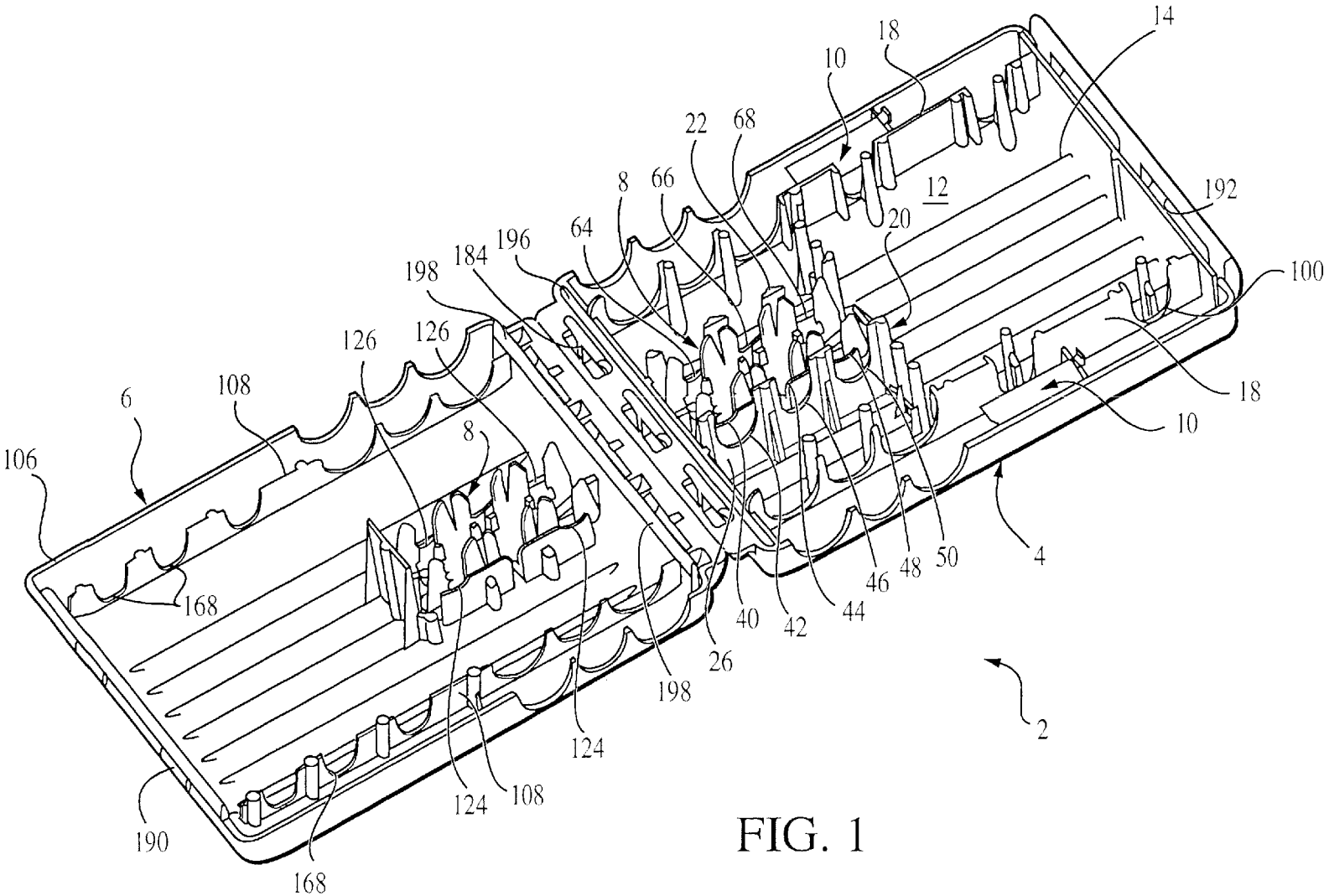
FIG. 1 is an isometric view of the subject enclosure in the open state.
Figure 2:
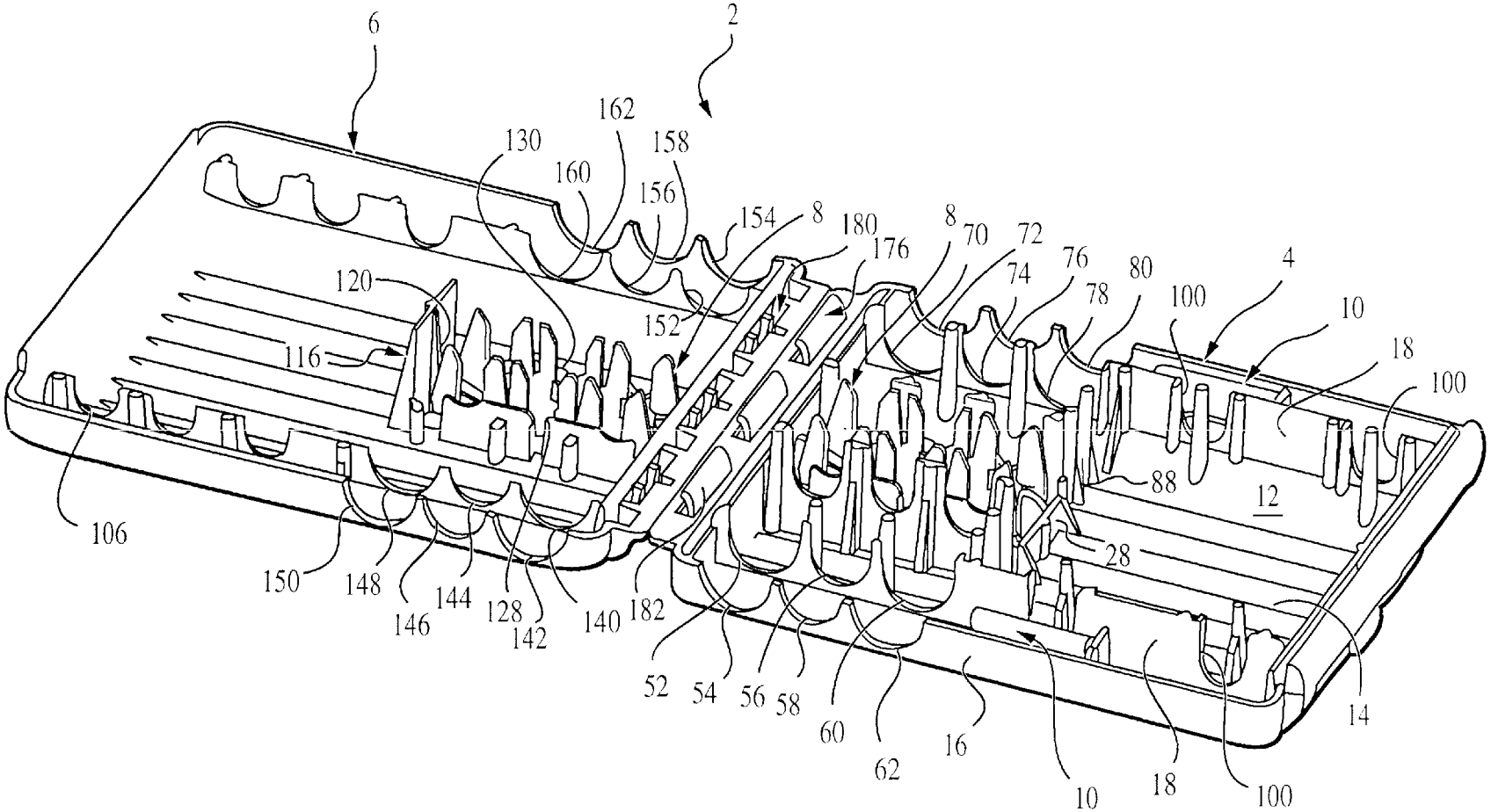
FIG. 2 is an isometric view similar to that of FIG. 1 taken from a different perspective.
Figure 3:
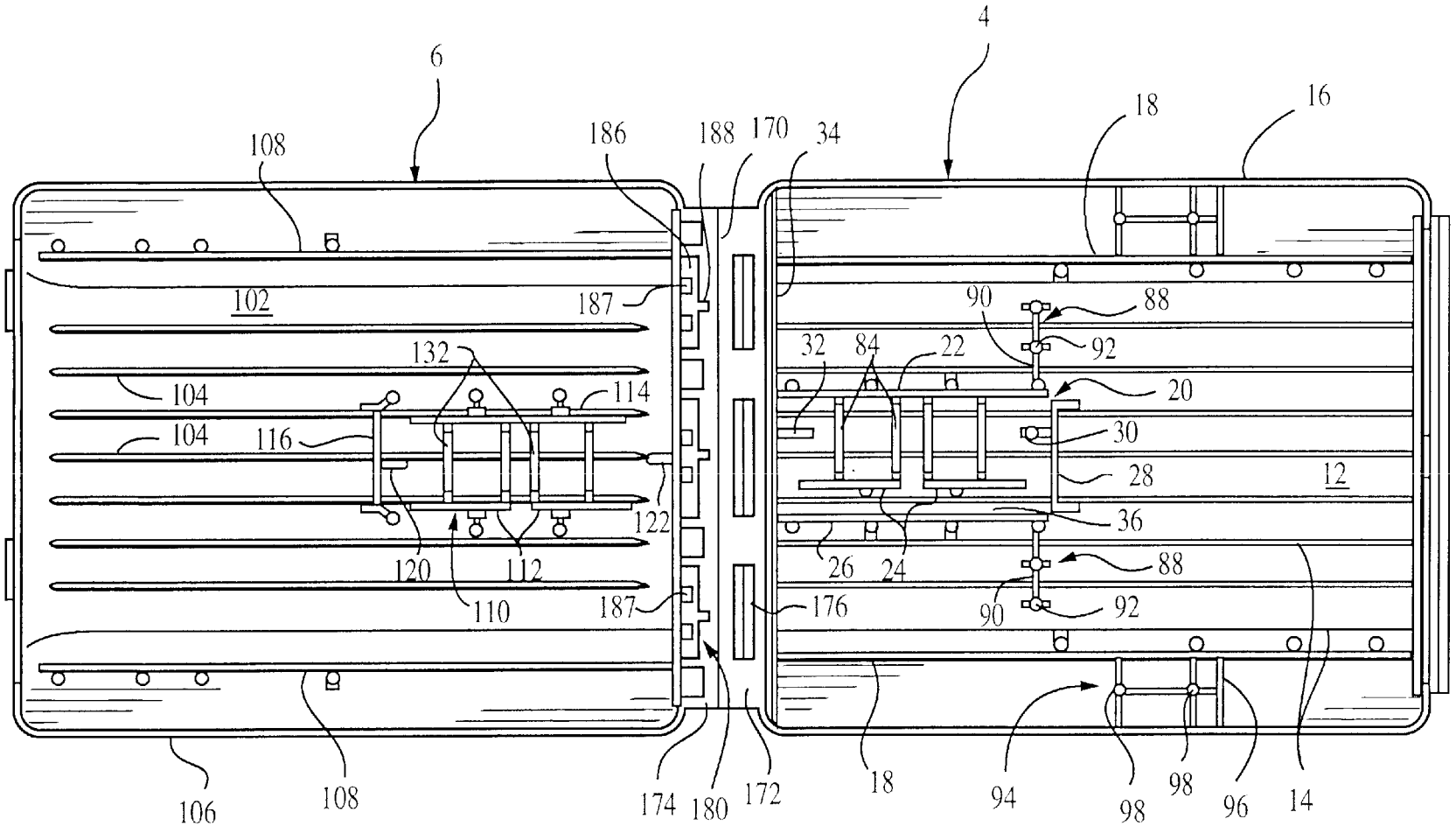
FIG. 3 is an upper plan view of the enclosure housing of FIGS. 1 or 2 with the grounding contacts removed.

With respect first to FIGS. 1 and 2, the invention will be described in greater detail. As shown, a splicing enclosure is shown generally as reference 2, which incorporates a housing comprised of a first housing portion, or base portion 4, and a second housing portion or lid 6. The enclosure 2 further comprises grounding contact members shown at 8, which common the shielding of spliced shielded cables as will be described in further detail. Finally, the enclosure 2 includes removable strain relief ferrules 10, which as shown in FIGS. 1 and 2, are shown in a stored position. With reference now to FIGS. 1 through 3, the housing member comprised of first and second housing portions 4 and 6 will be described in greater detail.

With respect first to FIG. 3, the base portion 4 is comprised of a base wall 12 provided with a plurality of strengthening ribs shown at 14. The base wall 12 includes an outer peripheral wall 16, which forms the concavity of the enclosure and further includes two spaced-apart and opposing walls at 18. The base portion 4 further includes a receiving nest 20 to receive the associated grounding contact 8 as shown in FIGS. 1 and 2. As shown best in FIG. 3, the nest 20 is comprised of a first wall 22, intermediate walls 24, and an outer wall 26. The nest 20 is bounded on its inner end by an upstanding wall at 28 as best shown in FIGS. 2 or 3. As also best viewed in FIG. 3, locking ribs 30 and 32 project upwardly to form locking surfaces for the grounding contact as will be described in greater detail. Locking rib 30 extends integrally upwardly from both the base wall 12 and the wall 28. Locking rib 32 extends upwardly from the base member 12 and integrally from an inner surface 34 of the peripheral wall 16.

As shown in FIG. 3, walls 24 and 26 are disposed in a parallel relation to each other and define a gap 36 therebetween. It should also be appreciated that the walls 24 and 26 are profiled to receive cables transversely thereof, see particularly FIG. 1 with contoured surfaces 40, 42; 44, 46; and 48, 50. It should also be appreciated that the opposing wall 18 and peripheral wall 16 are also profiled to receive a cable transversely therethrough, the opposing wall 18 and peripheral wall 16 including openings 52, 54; 56, 58; and 60, 62, as shown in FIG. 2. It should be appreciated that in comparing FIGS. 1 and 2, the pair of openings 52, 54 are aligned with the openings 40, 42; the openings 56, 58 are aligned with the openings 44, 46, and that the openings 60, 62 are aligned with the respective openings 48, 50. It should also be appreciated that the openings 52, 54; 40, 42; and 60, 62; 48, 50 are profiled to receive the same sized cable, and in the preferred embodiment of the invention are sized to receive a 12-pair shielded cable. As shown in FIG. 1, wall 22 also includes contoured surfaces to allow for a cable entrance, and includes surfaces 64, 66, and 68. With reference now to FIG. 2, contoured surfaces 70–80 are provided in walls 16 and 18 which are aligned with the surfaces 64, 66, and 68, that is, surfaces 70 and 72 are aligned with surface 64; surfaces 74, 76 are aligned with surface 66; and surfaces 78, 80 are aligned with surface 68. As shown best in FIG. 3, a support for the contact 8 is formed by a plurality of transversely extending ribs 84 extending intermediate the walls 22, 24. Finally, support walls 88 provide structural rigidity to the contact nest 28 and include a transverse wall portion 90 and a plurality of upstanding posts at 92. As shown in FIG. 3, a ferrule storage area is shown at 94 having an upstanding wall at 96 and upstanding posts at 98. The opposing walls 18 further comprise gel relief ports at 100, as shown in FIG. 1.

With respect to FIG. 3, the lid 6 includes a base wall 102 having structural ribs at 104. The lid 6 further includes a peripheral wall at 106 and opposing walls at 108. Upstanding walls 112 and 114, together with end wall 116, provide a secondary contact-receiving nest 110. In a like manner as the contact receiving nest 20, contact receiving nest 110 further includes retaining ribs 120 and 122 (FIG. 3); contoured surfaces 124, 126, 128, and 130 (FIGS. 1 and 2); and transversely extending ribs 132. As also shown in FIGS. 1 and 2, the outer peripheral wall 106 and the opposing wall 108 further include cable-receiving openings similar to items 52–62, and 70–80. As shown in FIG. 2, openings 140, 142 cooperate with openings 52, 54; openings 144, 146 cooperate with openings 56, 58; and openings 148 and 150 cooperate with openings 60, 62, to complete the cable receiving openings. Similarly, openings 152, 154 cooperate with openings 70, 72; openings 156, 158 cooperate with openings 74, 76; and openings 160, 162 cooperate with openings 78, 80. The opposing walls 108 further comprise gel relief ports at 168, (FIG. 1).

With respect again to FIGS. 1 through 3, the housing portions 4 and 6 are shown as integrally molded about their edges, that is, about a hinge 170 formed between support walls 172 and 174. An edge latching system is comprised of projections 176 and complementary openings 180, as best shown in FIG. 2. Each of the projections 176 includes a curved wall portion 182 (FIG. 2) and an upstanding support rib 184 (FIG. 1). Each of the openings 180 is comprised of a T-shaped slot including an elongate portion 186 and a transverse portion at 188 (FIG. 3). It should be appreciated that each of the projections 176 is receivable in sliding engagement with a corresponding opening 180 as will be further described herein.

Figure 4:
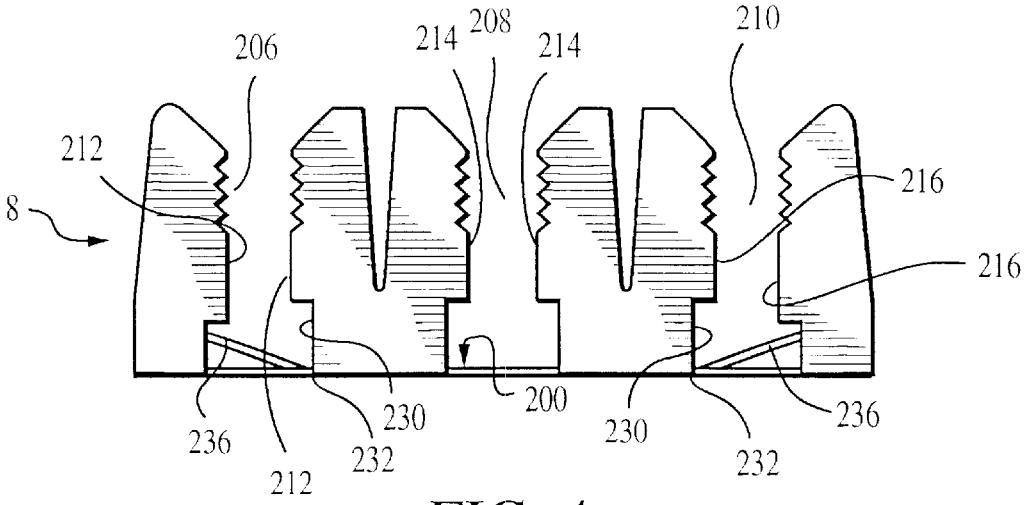
FIG. 4 is a side plan view of the grounding contact shown in FIGS. 1 or 2.
Figure 5:
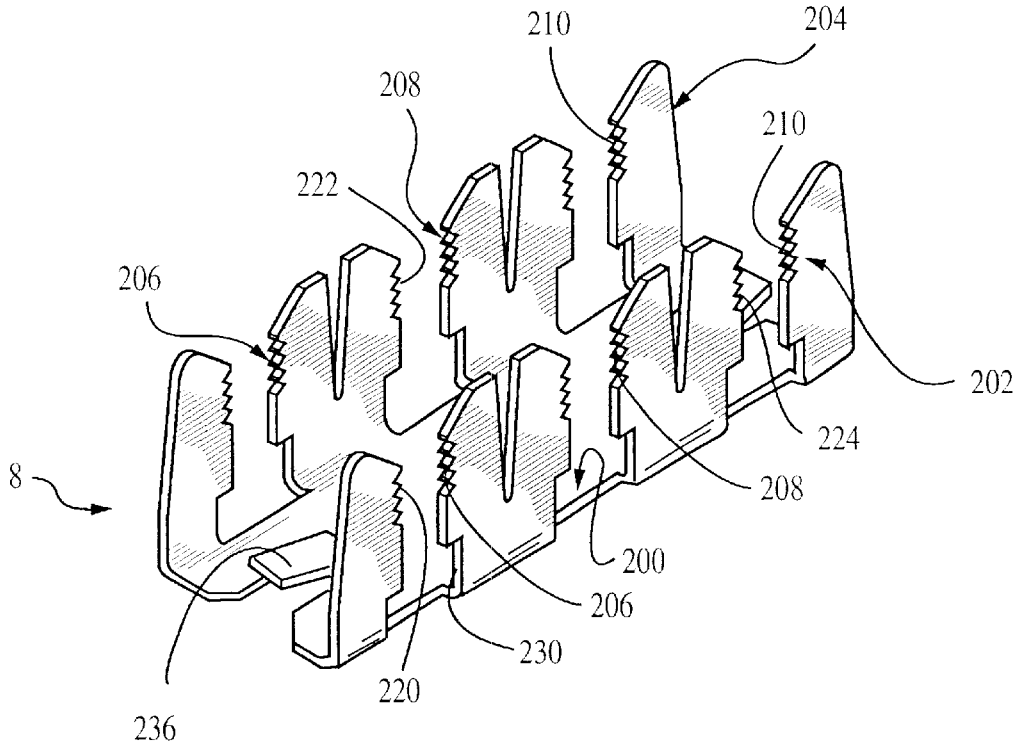
FIG. 5 is an isometric view of the grounding contact of FIG. 4.

With respect now to FIGS. 4 and 5, the grounding contact 8 will be described in greater detail. The contact 8 is comprised of a base portion 200 having generally upstanding wall sections at 202 and 204. The wall sections 202 and 204 define a plurality of grounding contact portions at 206, 208, and 210. Each of the contact portions 206–210 is comprised of side edges 212, 214, and 216, respectively, having serrated edges at 220, 222, and 224. Also with respect to FIG. 4, due to the cut-out sections 230, the base portion 200 of the contacts 8 are bendable at 232, at both ends as will be described in greater detail herein. Finally, as shown in FIGS. 4 and 5, the contact member 8 includes a locking lance 236 which has been struck from the base portion 200 to lock the contact in place in the housing as will also be described in greater detail herein.

Figure 6A:
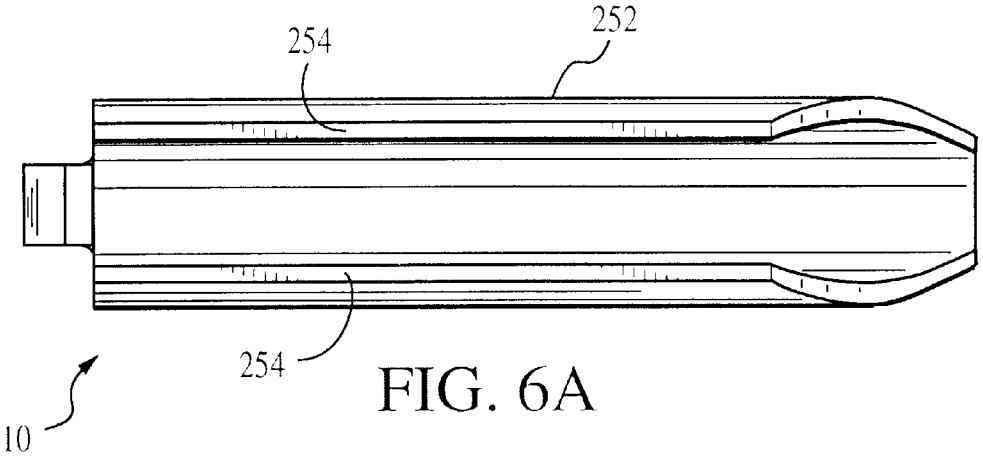
FIG. 6A is an upper plan view of the strain relief ferrule utilized in the subject invention.
Figure 6B:
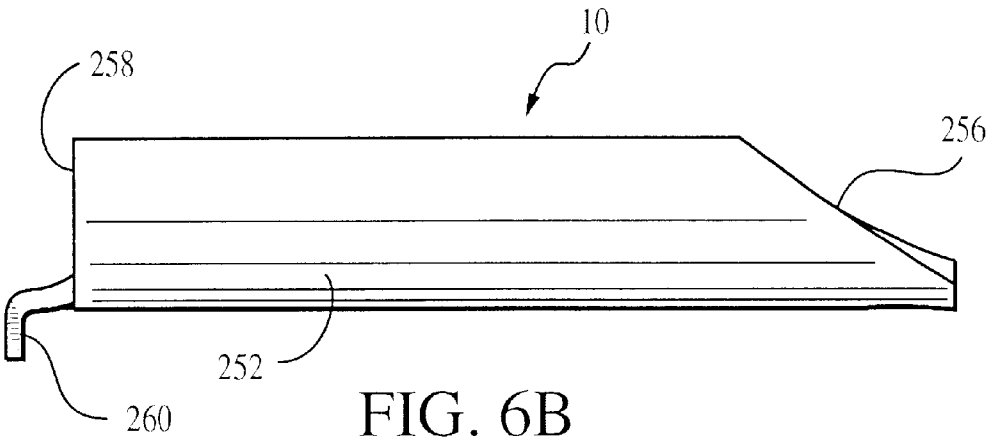
FIG. 6B is a side plan view of the strain relief ferrule of FIG. 6A.
Figure 6C:
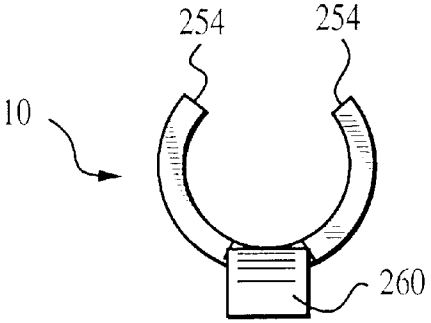
FIG. 6C is an end view of the strain relief ferrule of either of FIGS. 6A or 6B.

With respect now to FIGS. 6A and 6C, the ferrule 10 is disclosed as including a substantially cylindrical barrel portion 252 formed from rolling to include top edges at 254. The ferrule 10 further includes a front leading edge at 256 and a rear edge at 258. A gripping tab 260 extends integrally from the rear edge 258 as will be described in further detail.

Figure 7:
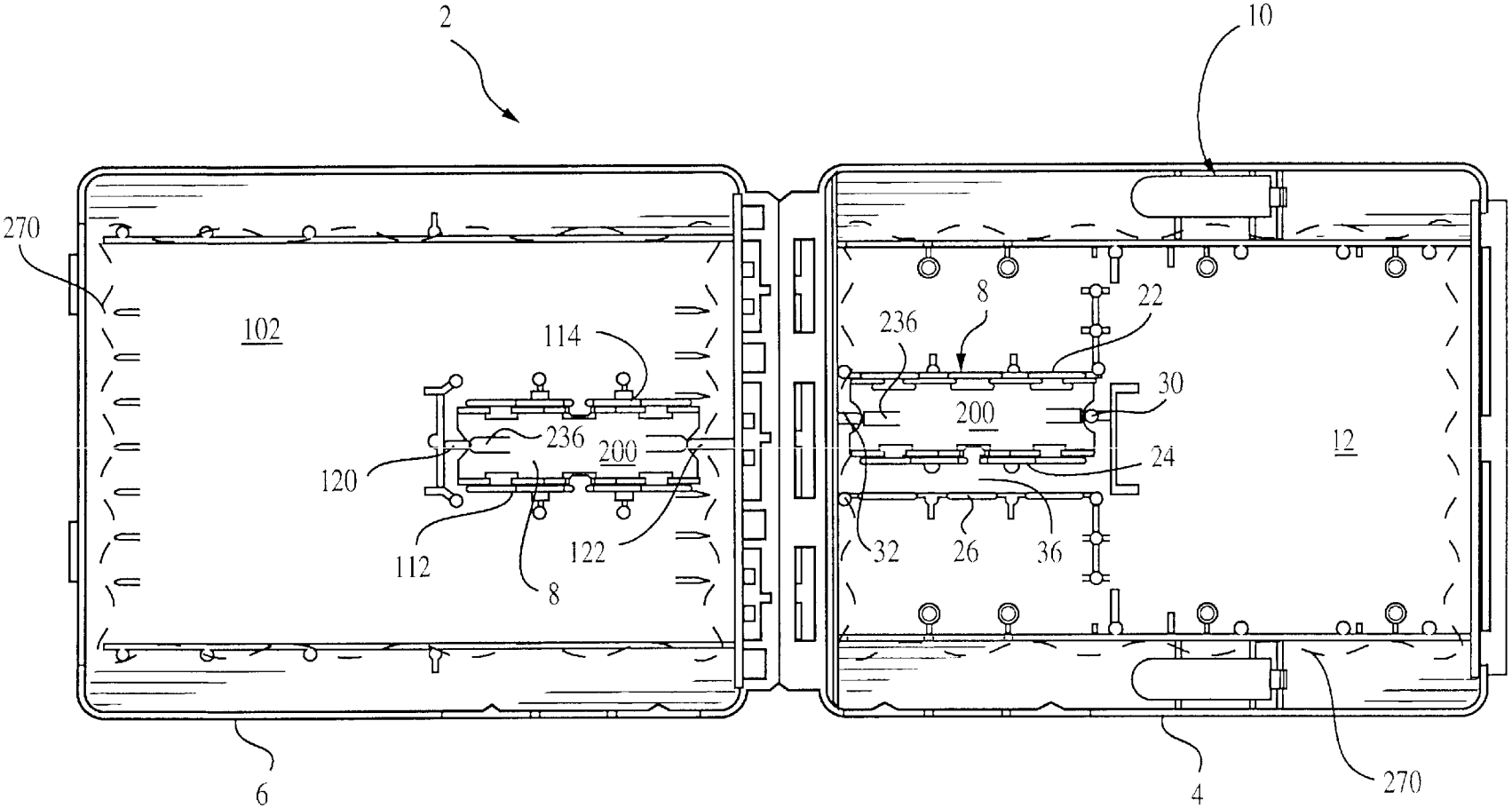
FIG. 7 is an upper plan view similar to that of FIG. 3 showing the grounding contacts in position.

With the components described with respect to FIGS. 1 through 6, the assembly of the apparatus will be described with greater detail. With reference to both FIGS. 3 and 7, the grounding contacts 8 are positioned between respective walls 22 and 24; and 112, 114. The contacts are inserted into their respective positions such that the base portions 200 of the grounding contacts 8 contact the transverse wall portions 84 and 132 of the respective receiving nests. This places the locking lances 236 in locking engagement with the respective ribs 30, 32; 120, 122. It should also be noted that a grease or gel 270 can also be placed in and around the base and lid as shown at 270, and can be placed in the unit prior to the termination of the various cables, or could be injected afterwards.

Figure 8:
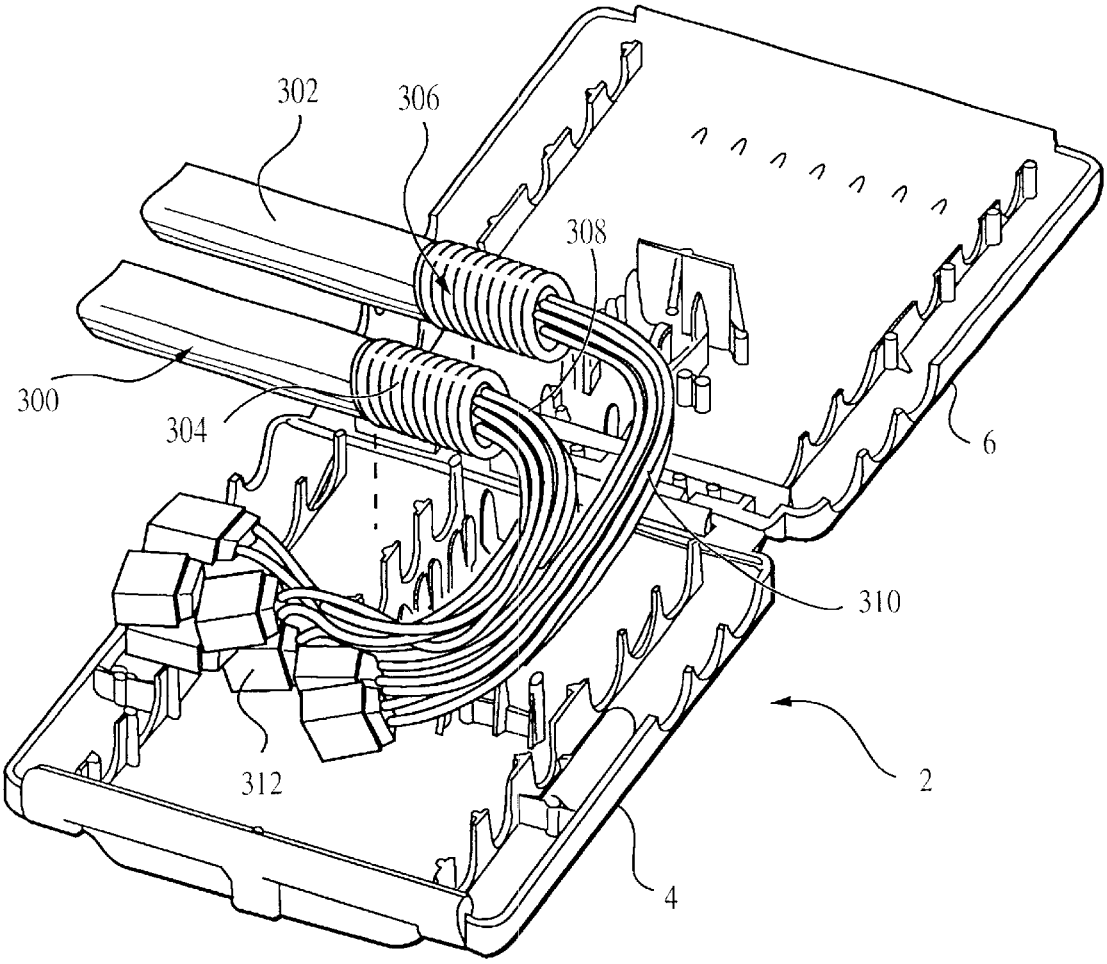
FIG. 8 is a perspective view of the enclosure illustrating two 12-pair cables spliced together, poised for receipt in the enclosure.
Figure 9:
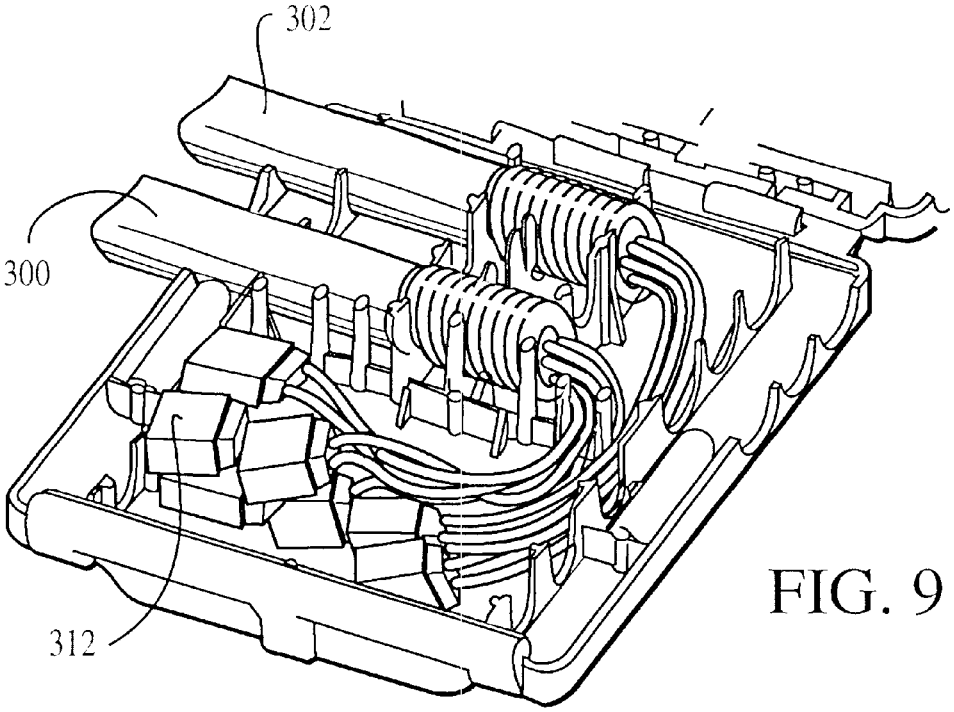
FIG. 9 shows the configuration of two 12-pair cables in a butt splice configuration.
Figure 10:
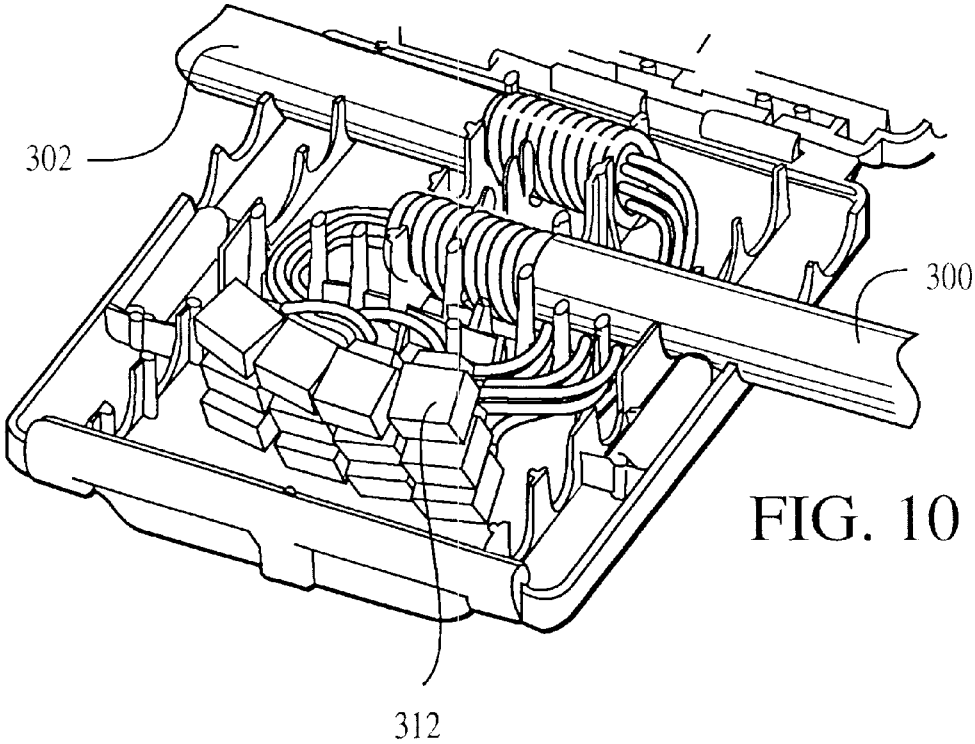
FIG. 10 shows two 12-pair cables in an in-line configuration.
Figure 11:
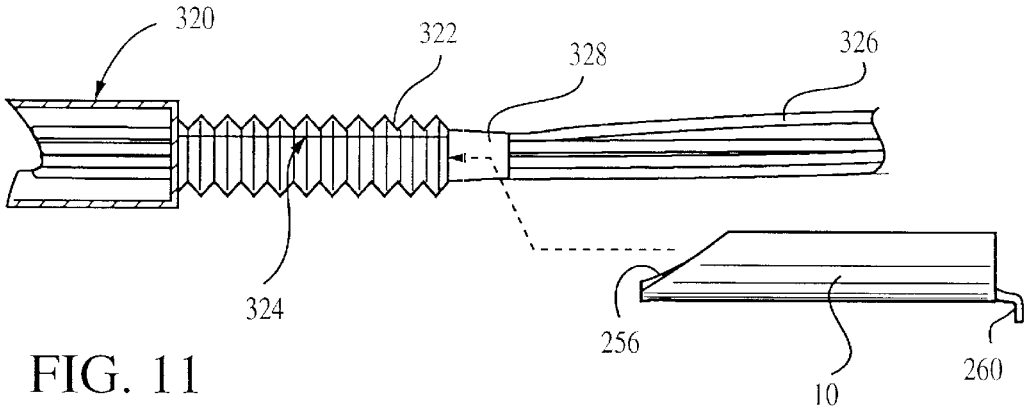
FIG. 11 shows the incorporation of the strain relief ferrule with a 6-pair cable.
Figure 12:
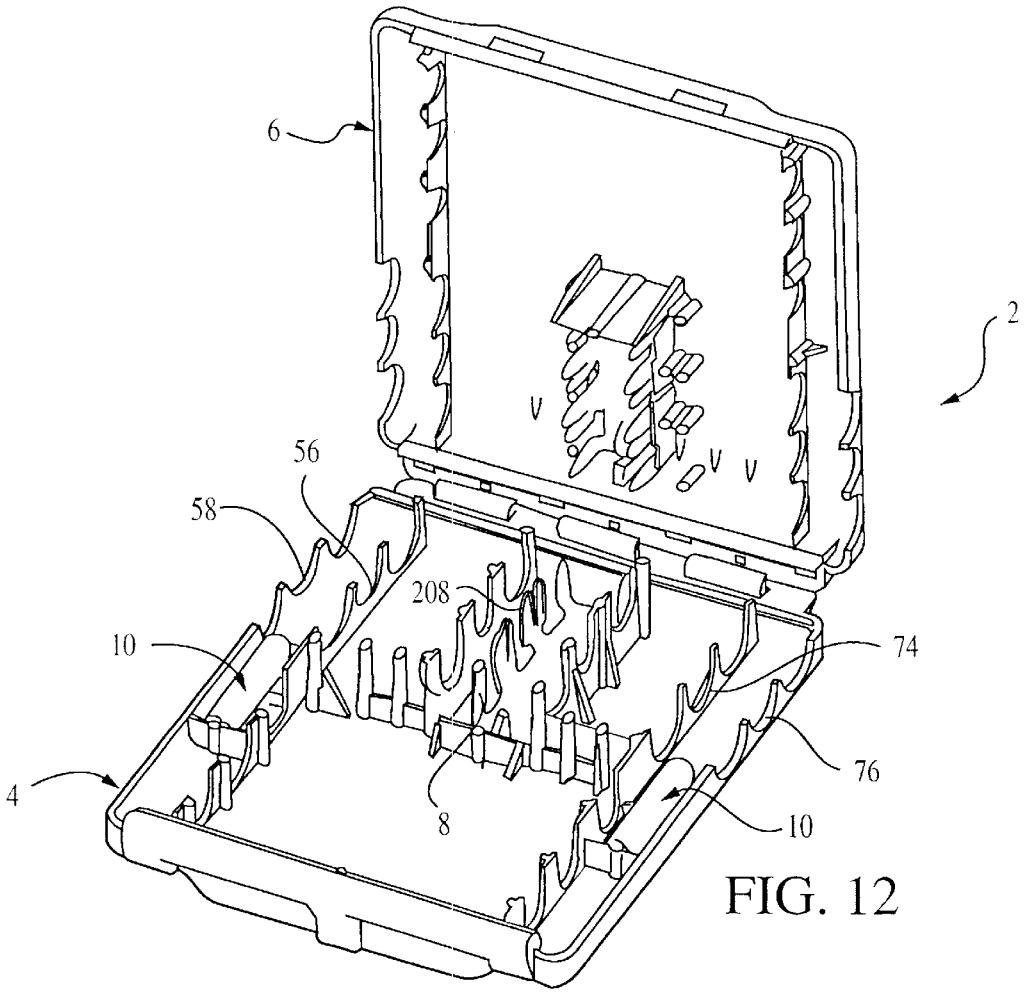
FIG. 12 shows a perspective view of the enclosure for use with the 6-pair cable.

With respect now to FIG. 8, the application of the enclosure 2 as a splicing member will be described. As shown in FIG. 8, the enclosure can be used to splice two cables 300, 302 where each of the cables includes inner shielding 304, 306, which shields individual twisted pair conductors 308, 310. As shown, the cables 300 and 302 have been terminated by a plurality of electrical splicing connectors such as 312, which could be the TEL-SPLICE connectors as described above. As shown in FIG. 8, cables 300 and 302 are shown as 12-pair cables, and as such, will be positioned in grounding contacts portions 206 and 210 (FIGS. 4 and 5) as will be further described herein. As shown in FIG. 9, the layout of the grounding contact allows for the splicing of the cable to be in a butt splice arrangement, as well as an in-line configuration as shown in FIG. 10. With respect now to FIGS. 11 and 12, in the event that a smaller cable, for example, a 6-pair shielded cable is to be spliced, such as a cable shown at 320, the cable is prepared by stripping the insulation back a sufficient portion to expose a length of the shielding sheath 322 for a length similar in length to the strain relief ferrule 10. As shown in FIG. 11, this should be accomplished by providing an exposed portion of the inner sheath 328, with the individual twisted pair of conductors 326 extending therefrom. The seam 324 of the shield can be opened to receive the ferrule 10 therein. As the ferrule has a leading edge portion, the ferrule can be grasped by the tab 260, for example, by a pair of pliers, and be slidably received so as to be positioned between the shield 322 and the inner sheath 328. The ferrule 10 rigidifies the cable diameter and can now be received in a transverse relation, similar to that shown in FIGS. 9 and 10, but can be received in the center grounding contact portion 208 of the grounding contact 8. Thus, the 6-pair cable 320 would be positioned either in openings 56, 58, or 74, 76 (FIG. 2).

Figure 13A:
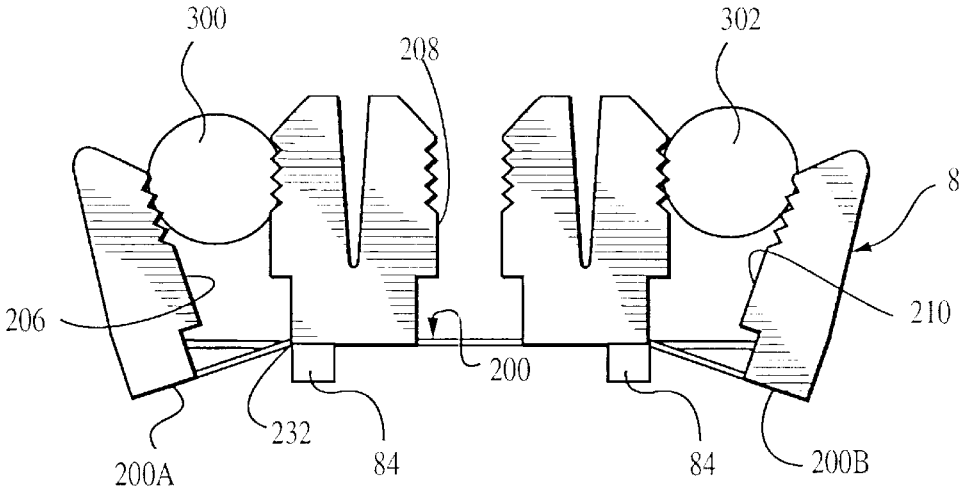
FIGS. 13A–13C show various diagrammatical views showing the incorporation of spliced cable.
Figure 13B:
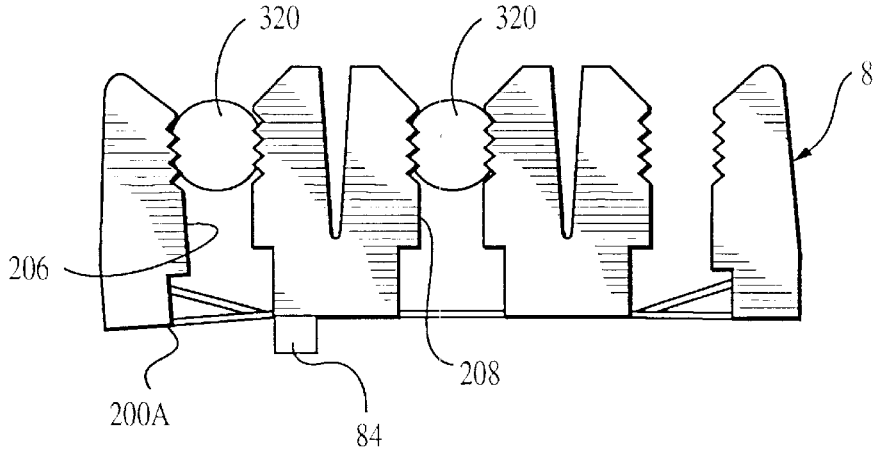
Figure 13C:
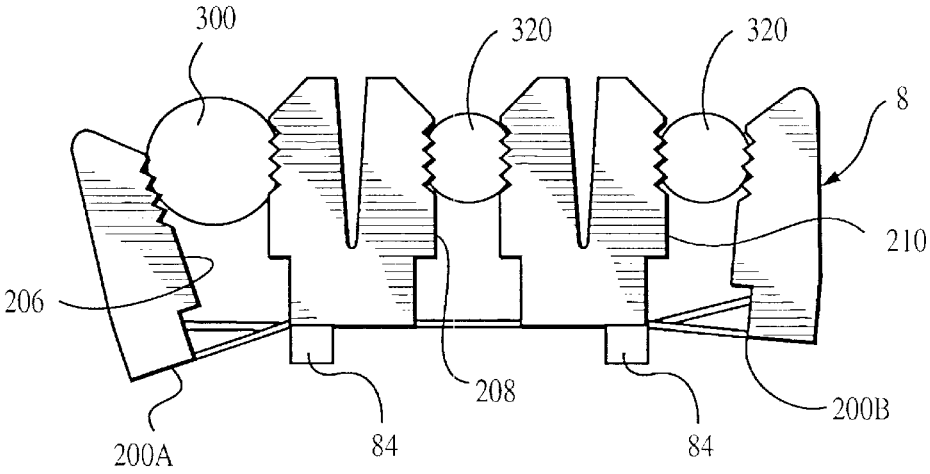

With reference now to FIGS. 13A–13C, various configurations of spliced cable are shown. With reference first to FIG. 13A, the splice is shown diagramatically to be similar to that of either FIG. 9 or 10, where two 12-pair cables 300, 302 are positioned within ground contacting portions 206 and 210. As shown in FIG. 13A, the grounding contact 8 is designed such that the distance between adjacent serrated edges 220 (FIG. 5) in the contact portions 206 and 210, is greater than the outer diameter of the cable-shielded portion of the cables 300 and 302. This requires that the base portion 200, labeled 200A in FIG. 13A, which is proud of the transverse housing ribs 84 deflects downwardly as shown to enlarge the distance between adjacent serrated edges. As shown in FIG. 13A, the same holds true of base portion 200B of the base portion 200 which receives cable 302. FIG. 13A represents the splicing of two 12-pair cables in either the in-line or butt splice position.

With respect now to FIG. 13B, if a 6-pair cable is terminated, and is prepared as shown in FIG. 11, the cable is terminated in the center contacting portion 208 and in one of the contacting portions 206 or 210. Due to the smaller diameter of the cable 320, the deflection of base portion 200A is less severe, than that previously shown in FIG. 13A. FIG. 13B represents the splicing of two 6-pair cables in either the in-line or butt splice position.

With respect now to FIG. 13C, two 6-pair cables 320 can be spliced and interconnected to a 12-pair cable 300 whereby the 12-pair cable can be positioned in grounding contact portion 206, one of the 6-pair cables 320 can be positioned in the center grounding contact portion 208, and the other 6-pair cable can be positioned in grounding contact portion 210. FIG. 13C represents the splicing of a single 12-pair cable to two 6-pair cables.

As described above, the present invention provides for an enhanced strain relief on the interconnection between the shield of a shielded cable and the grounding contact, as well as provides for an increased variety of cable splicing possibilities. Furthermore, as the grounding contacts are provided in both housing portions 4, 6, the strain relief is enhanced. Furthermore, the grounding contacts 8 are laterally offset, as best viewed in FIG. 2, such that the shielding of each cable is captured and sandwiched at four lateral locations along the cable. As the ground contact portion in lid 6, will fit in the gap 36, the cables can be adequately held in place along the length.

What is claimed is:

1. An electrical splicing enclosure for splicing a plurality of shielded cables, comprising:

an insulating housing having a first housing member and a second housing member, said first housing member being hinged to said second housing member so that said first housing member and second housing member are movable from an open position to a closed position where said first housing member and said second housing member overlie each other, said first housing member and said second housing member each having a base wall, and a peripheral wall, said peripheral walls conforming to provide the enclosure when in said closed position, and at least two cable receiving openings provided through said housing for said cables to be spliced; and grounding contacts carried by said first and second housing members, said grounding contacts comprising cable receiving slots having gripping edges to grip shielding of said shielded cables to be spliced, said grounding contacts being profiled for overlapping contact with said cables, so as to trap said cable there between, and to provide strain relief thereto.

2. The enclosure of claim 1, further comprising a ferrule insertable under the shielding of said cables to be spliced, to enhance said strain relief effect on said cable.

3. The enclosure of claim 1, wherein said grounding contacts are positioned in, and held by, contact receiving nests, profiled by upstanding wall sections.

4. The enclosure of claim 3, wherein said nests are laterally offset from each other, such that said grounding contacts engage the shielding of the cable in an overlapping manner.

5. The enclosure of claim 1, wherein each of said grounding contacts is a unitary member having multiple cable receiving slots.

6. The enclosure of claim 5, wherein said grounding contacts are comprised of a base contact portion having upstanding wall sections extending from marginal edges thereof, said cable receiving slots being formed in said upstanding wall sections.

7. The enclosure of claim 6, wherein said cable receiving slots are comprised of upwardly facing openings in opposing walls of said upstanding wall sections, such that said cables are terminated transversely of said upstanding wall sections.

8. The enclosure of claim 7, wherein said grounding contacts have at least one central cable receiving slot and an end cable receiving slot on opposite sides of said central cable receiving slot.

9. The enclosure of claim 8, wherein said end cable receiving slots are profiled to accept a plurality of wire sizes.

10. The enclosure of claim 9, wherein said base contact portions of said grounding contacts are deformable through a line parallel with said slots.

11. An electrical splicing enclosure for splicing a plurality of shielded cables, comprising:

an insulating housing for enclosing cables to be spliced, said housing having at least two cable receiving openings provided therethrough for said cables to be spliced;

at least one grounding contact carried by said housing, said grounding contact comprising cable receiving slots having gripping edges to grip shielding of said shielded cables to be spliced; and a ferrule removably mounted in said housing, said ferrule being profiled to be receivable beneath the shielding of one of said cables to be spliced, whereby said ferrule is stored in said housing and is available to be applied to said one cable to rigidify a connection with said grounding contact and to provide strain relief of said one cable with said grounding contact.

12. The enclosure of claim 11, wherein said housing comprises a first housing member and a second housing member, said first housing member being hinged to said second housing member so that said first housing member and second housing member are movable from an open position to a closed position where said first housing member and said second housing member overlie each other.

13. The enclosure of claim 12, wherein said first housing member and said second housing member each have a base wall and a peripheral wall, said peripheral walls conforming to provide an enclosure when said first and second housing members are in the closed position.

14. The enclosure of claim 12, comprising two grounding contacts, wherein said grounding contacts are carried by said first and second housing members, said grounding contacts comprising cable receiving slots having gripping edges to grip shielding of the shielded cables to be spliced, said grounding contacts being profiled for overlapping contact with the cables, so as to trap said cable there between, and to provide strain relief thereto.

15. The enclosure of claim 14, wherein each of said grounding contacts is a unitary member having multiple cable receiving slots.

16. The enclosure of claim 15, wherein said grounding contacts are comprised of a base contact portion having upstanding wall sections extending from marginal edges thereof, said cable receiving slots being formed in said upstanding wall sections.

17. The enclosure of claim 16, wherein said cable receiving slots are comprised of upwardly facing openings in opposing walls of said upstanding wall sections, such that the cables are terminated transversely of said upstanding wall sections.

18. The enclosure of claim 17, wherein said grounding contacts have at least one central cable receiving slot and an end cable receiving slot on opposite sides of said central cable receiving slot.

19. The enclosure of claim 18, wherein said end cable receiving slots are profiled to accept a plurality of wire sizes.

20. The enclosure of claim 19, wherein said base contact portions of said grounding contacts are deformable through a line parallel with said slots.

* * * * *